US006120350A

United States Patent [19]

Zhou et al.

[11] Patent Number: 6,120,350

[45] Date of Patent: Sep. 19, 2000

[54] PROCESS FOR RECONDITIONING POLISHING PADS

[75] Inventors: Yi-yang Zhou, McKinney; Eugene C. Davis, Sherman, both of Tex.

[73] Assignee: MEMC Electronic Materials, Inc., St. Peters, Mo.

[21] Appl. No.: 09/282,391

[22] Filed: Mar. 31, 1999

[51] Int. Cl.[7] ..... B24B 49/18

[52] U.S. Cl. ..... 451/21; 451/56

[58] Field of Search ..... 451/21, 443, 444, 451/56, 288

[56] References Cited

U.S. PATENT DOCUMENTS

| | | | |
|---|---|---|---|
| 5,421,768 | 6/1995 | Fujiwara et al. | 451/283 |
| 5,456,627 | 10/1995 | Jackson et al. | 451/11 |
| 5,486,131 | 1/1996 | Cesna et al. | 451/444 |
| 5,527,424 | 6/1996 | Mullins | 451/444 |
| 5,531,635 | 7/1996 | Mogi et al. | 451/56 |
| 5,626,509 | 5/1997 | Hayashi | 451/285 |
| 5,643,067 | 7/1997 | Katsuoka et al. | 451/444 |
| 5,655,951 | 8/1997 | Meikle et al. | 451/56 |
| 5,664,987 | 9/1997 | Renteln | 451/444 |
| 5,665,656 | 9/1997 | Jairath | 438/692 |
| 5,667,433 | 9/1997 | Mallon | 451/287 |
| 5,840,202 | 11/1998 | Walsh | 216/52 |
| 5,951,370 | 9/1999 | Cesna | 451/21 |

FOREIGN PATENT DOCUMENTS

| | | |
|---|---|---|
| 0803327A2 | 10/1997 | European Pat. Off. . |
| 10-34519 | 2/1998 | Japan . |

*Primary Examiner*—Robert A. Rose

*Attorney, Agent, or Firm*—Senniger, Powers, Leavitt & Roedel

[57] ABSTRACT

A pad shaping tool for shaping a polishing pad. The tool includes a disk having a first side and a second side and at least two discontinuous pad shaping surfaces located in spaced apart positions relative to each other on the first side of the disk. The pad shaping surfaces are simultaneously engageable with a polishing surface of the polishing pad for shaping the polishing surface as the pad rotates relative to the tool to change a cross sectional profile of the polishing surface from a curved shape to a flatter shape. A process for reconditioning the polishing pad on a rotatable platform of a wafer polishing machine includes the steps of engaging the pad shaping tool with the polishing surface of the pad such that at least two discontinuous pad shaping surfaces of the tool simultaneously engage the polishing surface, and rotating the polishing pad while preventing translational movement of the tool relative to the pad so that the tool shapes the polishing surface of the pad to be more nearly flat.

7 Claims, 2 Drawing Sheets

PROCESS FOR RECONDITIONING POLISHING PADS

BACKGROUND OF THE INVENTION

This invention relates generally to maintenance of polishing pads for semiconductor wafers and more particularly to an apparatus and process for reconditioning polishing pads to maintain flatness.

Semiconductor wafers are generally prepared from a single crystal ingot, such as a silicon ingot, which is sliced into individual wafers. Each wafer is subjected to a number of processing operations to facilitate the installation of integrated circuit devices and to improve their yield, performance, and reliability. Typically, these operations reduce the thickness of the wafer, remove damage caused by the slicing operation, and create a flat and reflective surface. Chemical-mechanical polishing of semiconductor wafers is one of these operations. It generally involves rubbing a wafer with a polishing pad while dispensing a slurry containing an abrasive and chemicals, such as a colloidal silica and an alkaline etchant, to produce a surface that is extremely flat, highly reflective, and damage-free.

The polishing pad is circular or annular in shape and has a polishing surface (i.e., that portion of the surface area of the pad which contacts and polishes the wafer) which must be extremely flat to produce wafers that are likewise flat. Unfortunately, polishing surfaces can acquire an uneven shape after use. In a conventional semiconductor wafer polisher, the wafer is held with force by a polishing arm against the rotating polishing pad. The polishing arm may also move the wafer across the polishing pad in an oscillatory fashion as the pad rotates. After a number of polishing cycles, pressure and heat on the polishing pad cause variations of pad shape in a central annular region of the pad that contacts the wafer. Further, the polishing surface becomes worn in the central annular region. Thus, the cross sectional profile of the polishing surface of the pad becomes nonplanar.

Slurry particles typically become deposited on polishing pads and further degrade polishing effectiveness. A typical polishing pad is made of a polyester felt impregnated with polyurethane resin. During a polishing process, particles from the slurry and reaction products become adhered to fibers in the pad. When the pad becomes soaked with slurry particles, its polishing ability is reduced. The particles can be unevenly distributed across the polishing surface, making the surface irregular. The combination of pad wear and slurry deposition can make the pad either concave or convex.

Accordingly, polishing pads must be periodically reconditioned, or dressed, to restore a flat cross sectional profile and scrape away deposited slurry particles. One way reconditioning is accomplished is by using a dressing wheel which carries abrasive material on a pad shaping surface of the wheel. The wheel is held in position over the polishing surface with its pad shaping surface engaging the pad. The wheel is restricted from rotating about the axis of rotation of the pad as it turns, but may be permitted to freely rotate about its own center. The pad shaping surface rubs against the pad, abrading away the thicker portions so the profile is made more flat. Specifically, the inner and outer edge margins of the polishing surface are lowered to the level of the central region by abrading away the inner and outer edge margins. The tool also removes deposited particles of slurry. The abrasive material on the tool, such as diamond, is disposed in a continuous ring located at the periphery of the tool.

The pad shaping tool can become slightly misaligned with the polishing pad resulting in uneven shaping. The tool is typically held by a connector at its center to a fixture generally above the pad shaping surface. The fixture holds the pad shaping surface generally parallel the pad, and has a bearing that engages the connector and permits the tool to rotate about its center. As the pad moves relative to the abrasive material of the pad shaping tool, frictional force from the pad drives the tool to move along with the pad. The fixture opposes the force and holds the tool from translating with the pad. However, the force creates a moment about the bearing and the fixture, since they are spaced above the point of force application. The moment urges the tool to pivot about a point at the connector between the tool and the fixture.

Mechanisms for attaching tools, such as the bearing and the fixture, often have some degree of flexibility and looseness that allows a finite movement when opposing forces or moments. The moment from the frictional force induces a deflection in the fixture so that the tool pivots a small angle and is no longer in horizontal alignment with the pad. A leading edge of the abrasive surface of the tool (i.e., the side of the wheel that first contacts the central annular region of the rotating pad) is pushed relatively more into the pad, while the trailing edge of the tool (i.e., the side of the wheel that last contacts the rotating pad) is pushed relatively less into the pad. After sufficient abrasion to an equilibrium, the pad shape should conform with the shape of the abrasive material at the tool peripheral. However, because of pivoting, the cross sectional profile of the polishing surface becomes concave.

Thus, the frictional force creates a moment that pivots the tool and tends to make the pad profile concave. The tendency yields uncertain results, and operators have devised various cumbersome procedures for reconditioning pads that vary depending on the initial profile (i.e., whether convex or concave). For instance, when a pad is convex the wheel may be allowed to rotate but when a pad is concave the rotation of the wheel is restricted. These procedures often yield non-repeatable results and may require trial and error to obtain polishing pads that are flat.

SUMMARY OF THE INVENTION

Among the several objects and features of the present invention may be noted the provision of an apparatus and process for reconditioning a polishing surface of a polishing pad which restores a flat cross sectional profile land removes deposited slurry particles; the provision of such apparatus and process that evenly abrades the pad across the polishing surface; the provision of such apparatus and process that can be used for pads regardless of initial profile; and the provision of such apparatus and process which are economical and easy to use.

Briefly, a pad shaping tool of the present invention shapes a polishing pad having a polishing surface defined by a radially inner and a radially outer boundary and a cross sectional profile between its radially inner and outer boundaries which changes as the polishing pad is used to polish objects. The tool comprises a disk having a first side and a second side, the disk being adapted for mounting in position on the polishing surface, and at least two discontinuous pad shaping surfaces located in spaced apart positions relative to each other on the first side of the disk. The pad shaping surfaces are simultaneously engageable with the polishing surface of the polishing pad for shaping the polishing surface as the pad rotates relative to the pad shaping tool to change the cross sectional profile of the polishing surface from a curved shape to a flatter shape.

In another aspect, a process of the present invention for reconditioning a polishing pad on a rotatable platform of a wafer polishing machine comprises the steps of engaging a pad shaping tool with a polishing surface of the pad such that at least two discontinuous pad shaping surfaces of the tool simultaneously engage the polishing surface, with the pad shaping surfaces being located in spaced apart positions relative to each other on the tool. The polishing pad is rotated while translational movement of the pad shaping tool relative to the pad is prevented so that the pad shaping tool shapes the polishing surface of the pad to be more nearly flat.

In yet another aspect, a process of the present invention for polishing semiconductor wafers using a wafer polishing machine having a rotating polishing pad including a polishing surface defined by a radially inner boundary and a radially outer boundary, the polishing surface having a cross sectional profile between its radially inner and outer boundaries, comprises the steps of polishing at least one face of each of a first plurality of semiconductor wafers. The cross sectional profile is monitored to determine whether the profile of the polishing surface becomes more curved in shape than permitted by a process tolerance amount. If the determined shape of the profile of the polishing surface is more curved than the process tolerance amount, the polishing pad is shaped. The step of shaping the polishing pad is substantially as set forth in the preceding paragraph.

Other objects and features of the present invention will be in part apparent and in part pointed out hereinafter.

BRIEF DESCRIPTION OF THE DRAWINGS

Corresponding reference characters indicate corresponding parts throughout the views of the drawings.

DETAILED DESCRIPTION OF THE PREFERRED EMBODIMENT

Figure 1:
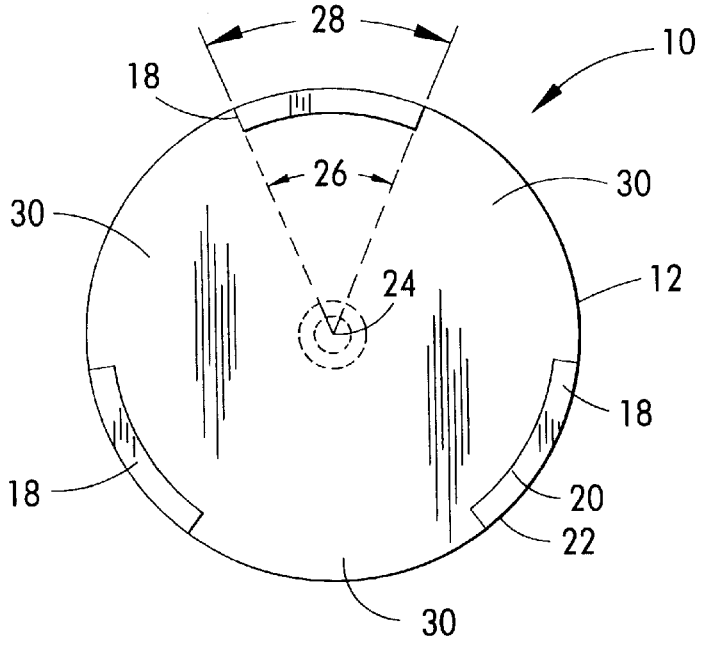
FIG. 1 is a bottom plan view of a pad shaping tool of the present invention illustrating a slotted wheel arrangement of abrasive pad shaping surfaces on the tool.
Figure 3:
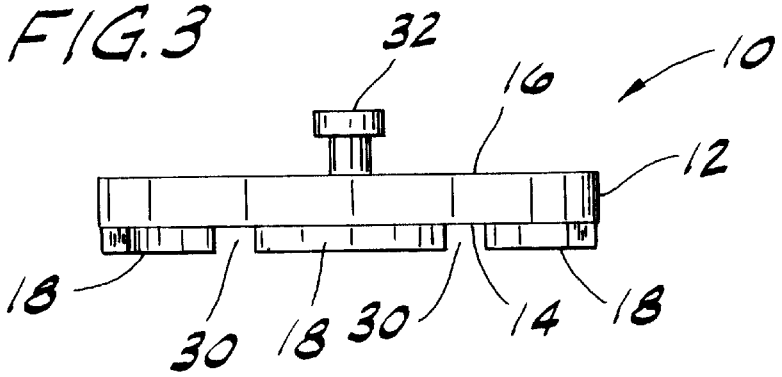
FIG. 3 is an elevational view of the pad shaping tool.

Referring now to the drawings and in particular to FIGS. 1 and 3, a pad shaping tool of the present invention for reconditioning semiconductor wafer polishing pads on a wafer polishing machine and having a slotted wheel arrangement is indicated generally at 10. The tool 10 comprises a flat disk 12 having a first side 14 and a second side 16, and three discontinuous pad shaping surfaces 18 located in spaced apart positions relative to each other on the first side of the disk. As shown in FIG. 1, the pad shaping surfaces 18 are located generally at the periphery of the first side 14 of the disk 12. The pad shaping surfaces 18 are fixedly attached to the disk 12. In the preferred embodiment, the disk 12 is made of stainless steel and the pad shaping surfaces 18 are made of a suitable abrasive material such as electrolytically plated diamond. It is envisioned that the tool 10 may be made of other materials, a non-circular shaped disk 12, or may have any number of discontinuous pad shaping surfaces 18 located anywhere on the disk without departing from the scope of the present invention.

Each pad shaping surface 18 has the shape of a segment of an arc, and is generally rectangular in cross section. The pad shaping surfaces 18 lie between two circles 20, 22 of different diameters having centers coincided with a center 24 of the first side of the disk 12. The two circles 20, 22 define between them an annular or wheel shape. A size of each pad shaping surface 18 may be defined by an angular extent 26 on the first side 14 of the wheel, measured with respect to the center 24 of the disk 12, and a corresponding arc segment length 28. In the preferred embodiment, the angular extent 26 and arc segment length 28 of each pad shaping surface 18 are approximately equal to the those of the other pad shaping surfaces. Spaces between the pad shaping surfaces 18, which lie generally between the two circles 20, 22 and outside of the angular extent of any pad shaping surface 18, comprise slots 30 in the wheel. The angular extent 26 of any pad shaping surface 18 generally ranges between 40° and 90°. Other angles and pad shaping surfaces having substantially different sizes do not depart from the scope of this invention.

Figure 2:
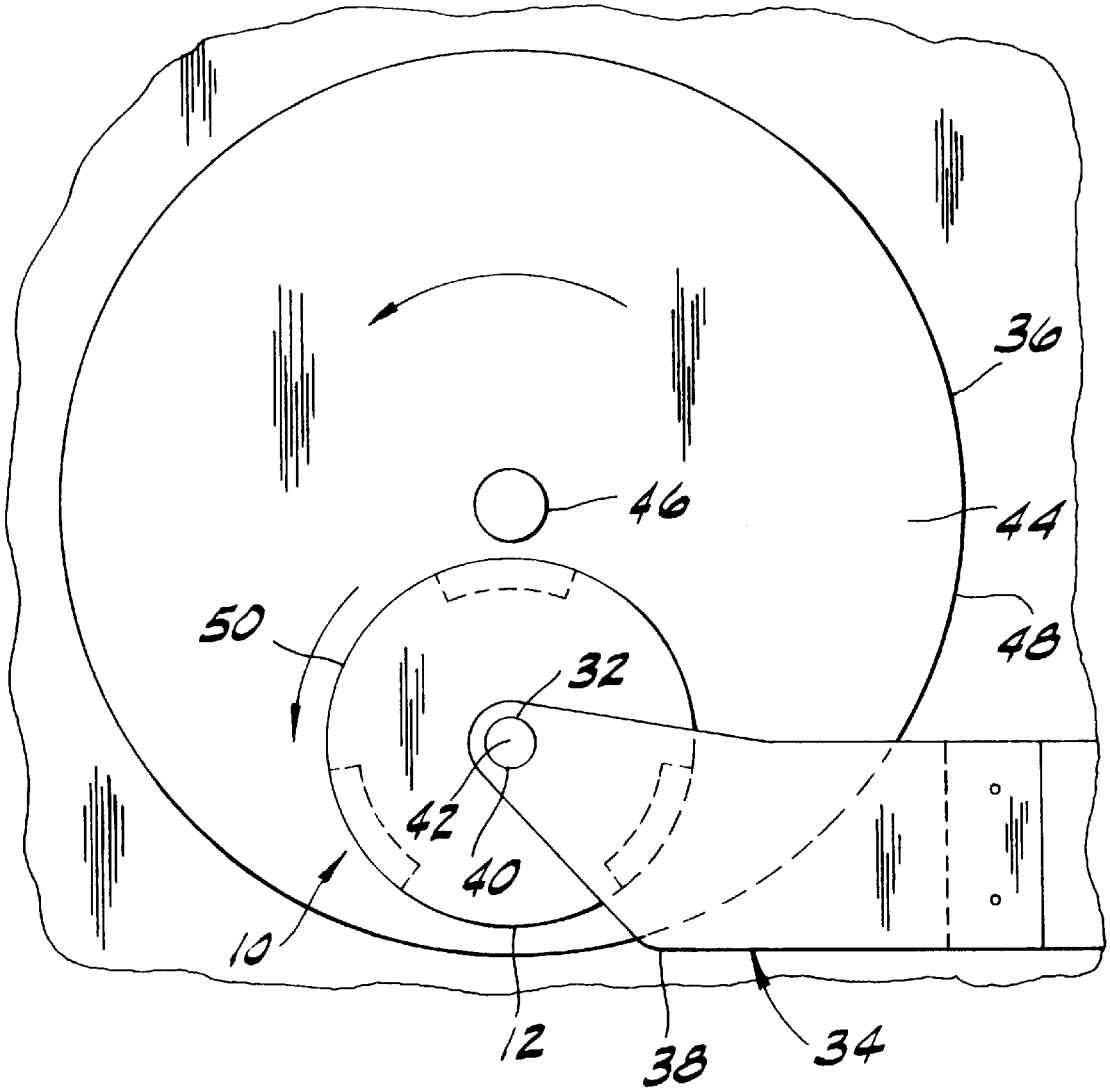
FIG. 2 is a fragmentary top plan schematic view of a polishing machine showing a fixture for holding the pad shaping tool against a polishing pad.

A connector 32 is on the second side 16 of the disk 12 and is constructed for rotatably attaching the tool 10 to a fixture 34 (FIG. 2) for holding the tool in a position in which the pad shaping surfaces 18 engage a polishing pad 36 on the wafer polishing machine. As seen in FIG. 2, the fixture 34 comprises an arm 38 for holding the tool 10 as the pad 36 rotates on the machine generally beneath the tool. The fixture 34 has a bearing 40 that permits the tool 10 to rotate about a central axis 42 at the center of the tool. The fixture 34 and connector 32 hold the tool 10 in general horizontal alignment with the pad 36. The construction and arrangement of the fixture 34 and the attachment of the tool 10 to the fixture is conventional and will not be further described herein.

In operation, the tool 10 is used to recondition polishing pads 36 on the wafer polishing machine in a manner similar to that in the prior art for wheel-shaped pad dressing tools. The polishing pad 36 has a polishing surface 44 defined by a radially inner boundary 46 and a radially outer boundary 48, and a cross sectional profile between its radially inner and outer boundaries, the profile being ideally flat. After a number of polishing cycles where the pad 36 rotates relative to wafers (not shown) to polish the wafers, the profile of the pad becomes curved. The shape of the profile of the pad is monitored by periodically measuring the flatness of a wafer polished by the pad 36, since after polishing, wafer shape generally corresponds to pad shape. For instance, one sample wafer after every 50 polished wafers may be measured for surface flatness. If the wafer deviates from being flat by more than a process tolerance amount, it is an indication that the profile of the pad 36 is unacceptably curved or soaked with slurry particles and requires reconditioning.

Wafer polishing is ceased while a pad reconditioning and shaping process is conducted. The fixture 34 is put in position where the pad shaping tool 10 engages the polishing surface 44 of the pad 36. The disk 12 is oriented generally parallel to the pad 36 so that all pad shaping surfaces 18 simultaneously engage the polishing surface 44. The polishing pad 36 is rotated while the fixture 34 holds the pad shaping tool 10. The tool 10 shapes the polishing surface 44 by abrading pad material as the pad 36 rotates relative to the tool, thereby changing the cross sectional profile of the polishing surface from a curved shape to a flatter shape. The fixture 34 prevents translational movement of the tool 10, but allows rotational movement of the tool about the central axis 42. The process is conducted for a suitable duration, as for example one minute, until the pad 36 is sufficiently flat and most of the deposited slurry particles are scraped from the pad. The tool 10 is removed from engagement with the pad 36, and additional wafers may be polished and their profiles periodically measured to assure the polishing pad is acceptably flat.

Figure 4:
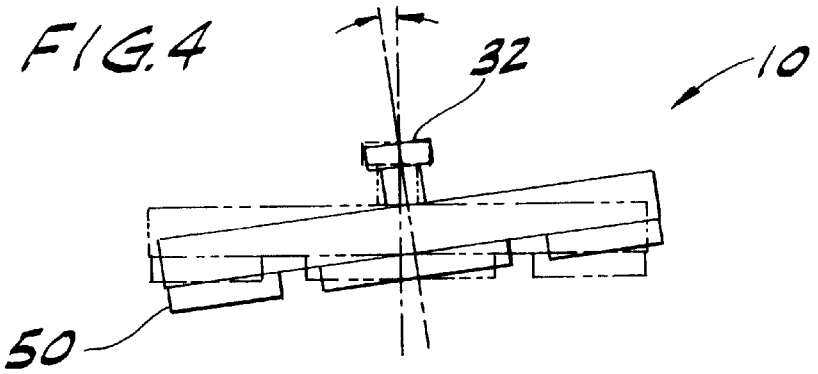
FIG. 4 is an elevational view of the pad shaping tool illustrating pivoting motion of the tool resulting from engagement with a moving polishing pad.

A significant feature of the present invention is that the pad shaping surfaces 18 are discontinuous, having the form of a wheel with slots 30. The slotted wheel has less contact surface area of abrasive material than a continuous ring of the same width. Therefore, as the pad 36 moves relative to the abrasive material of the pad shaping tool 10, frictional force from the pad, which is proportional to contact surface area, is relatively less than that on a full wheel. A moment about the connector 32 is realized as a result of the frictional force that urges the tool 10 to a pivoted orientation, as seen in FIG. 4. When the tool 10 pivots, a leading edge 50 of the tool is pressed relatively harder into the pad 36 so that it more readily abrades pad material in a central annular region of the pad that passes underneath.

The slotted wheel has less tendency than a full wheel to make the cross sectional profile of the polishing surface 44 concave. Because frictional force from the pad 36 is less than that for a full dressing wheel, it is believed that the magnitude of the moment is likewise reduced and the tool 10 is less strongly urged to pivot. The tool 10 stays more closely aligned with the pad 36 than full wheel tools, and there is less tendency to press and abrade the central annular region at a leading edge 50 of the tool. The slotted wheel configuration also is believed to have a different removal distribution pattern of pad material than a full wheel, which with the reduced moment tends to make the pad 36 more flat.

The sizes of the pad shaping surfaces 18 of the slotted wheel tool 10 may be optimized to improve wafer flatness. After reconditioning, if the shape of the cross sectional profile of the polishing surface 44 of the pad 36 is concave, then too much tool pivoting is indicated. The pad shaping surface 18 should be reduced in size to reduce the contact surface area, frictional force, and moment. Accordingly, a portion of at least one of the pad shaping surfaces 18 of the tool is removed, thereby decreasing a size of said at least one pad shaping surface. The portion removed would preferably be located at an end of one or more pad shaping surfaces 18 to reduce the angular extent 26 and the arc segment length 28. The step can be repeated until the tool 10 produces pads 36 with flat profile. If the shape of the cross sectional profile of the polishing surface 44 of the pad 36 is convex, then a lack of tool pivoting is indicated. The pad shaping surface 18 should be increased in size to increase contact surface area, frictional force, and moment. Accordingly, the pad shaping surfaces 18 should be enlarged, by affixing additional portions or by starting with a new, full wheel tool and removing appropriately sized portions. Once the sizes of the pad shaping surfaces 18 have been optimized, the tool 10 may be used for many pads, both concave and convex. Its pad shaping surfaces 18 are properly sized to create a moment that pivots the tool 10 and favors concavity which balances any tendency to favor convexity so that the polishing pad 36 is made flat.

The shape of the pad cross section to be obtained need not be flat. For instance, if an operator desires a concave or convex shape, the operator may select a tool 10 having a relatively larger or relatively smaller pad shaping surfaces 18 to control the resulting profile.

The apparatus and process of the present invention reconditions a polishing surface 44 of a polishing pad 36, restoring a flat cross sectional profile and removing deposited slurry particles. The tool 10 evenly abrades the pad 36 across the polishing surface 44 and permits the same tool operating in the same way to be used for pads regardless of initial profile.

In view of the above, it will be seen that the several objects of the invention are achieved and other advantageous results obtained.

As various changes could be made in the above without departing from the scope of the invention, it is intended that all matter contained in the above description and shown in the accompanying drawings shall be interpreted as illustrative and not in a limiting sense.

What is claimed is:

1. A process for polishing semiconductor wafers using a wafer polishing machine having a rotating polishing pad including a polishing surface defined by a radially inner boundary and a radially outer boundary, the polishing surface having a cross sectional profile between its radially inner and outer boundaries, the process comprising the steps of:

polishing at least one face of each of a first plurality of semiconductor wafers;

monitoring the cross sectional profile to determine whether the profile of the polishing surface from said first plurality of wafers becomes more curved in shape than permitted by a process tolerance amount;

if the determined shape of the profile of the polishing surface from said first plurality of wafers is more curved than the process tolerance amount, shaping the polishing pad, said step of shaping the polishing pad comprising the steps of:

engaging a pad shaping tool with the polishing surface, the tool having at least two discontinuous pad shaping surfaces that simultaneously engage the polishing surface, said pad shaping surfaces located in spaced apart positions relative to each other on the tool;

rotating the polishing pad while preventing translational movement of the tool so that the pad shaping tool shapes the polishing surface; and polishing at least one face of each of a second plurality of semiconductor wafers;

monitoring the cross sectional profile to determine whether the profile of the polishing surface from said second plurality of wafers becomes more curved in shape than permitted by the process tolerance amount;

if the determined shape of the profile of the polishing surface from said second plurality of wafers is more curved than the process tolerance amount, optimizing a size of the pad shaping surfaces of the tool to produce improved wafer flatness.

2. A process as set forth in claim 1 wherein the steps of monitoring the cross sectional profile of the polishing surface comprise the step of measuring the flatness of at least one of said wafers to determine whether the shape deviates from being flat by more than the process tolerance amount.

3. A process as set forth in claim 1 wherein the step of optimizing a size of the pad shaping surfaces of the tool comprises changing an angular extent of at least one pad shaping surface on the tool.

4. A process as set forth in claim 1 where the step of optimizing further comprises determining whether the shape of the profile of the polishing surface is concave; and if the shape is concave, removing a portion of at least one of the pad shaping surfaces of the tool, thereby decreasing a size of said at least one pad shaping surface, and repeating said steps of polishing and monitoring the cross sectional profile to determine if wafer flatness is improved.

5. A process as set forth in claim 4 wherein said step of removing a portion of at least one of the pad shaping surfaces includes reducing an angular extent of at least one pad shaping surface.

6. A process as set forth in claim 1 where the step of optimizing further comprises determining whether the shape of the profile of the polishing surface is convex; and if the shape is convex, enlarging a portion of at least one of the pad shaping surfaces of the tool, thereby increasing a size of said at least one pad shaping surface, and repeating said steps of polishing and monitoring the cross sectional profile to determine if wafer flatness is improved.

7. A process as set forth in claim 6 wherein said step of enlarging a portion of at least one of the pad shaping surfaces includes increasing an angular extent of at least one pad shaping surface.

* * * * *